United States Patent [19]

Berland

[11] 4,090,040

[45] May 16, 1978

[54] HEARING AID WITH ACOUSTICAL FREQUENCY RESPONSE MODIFICATION

[75] Inventor: Ole Berland, 32 Syrenvej, DK-2970 Horsholm, Denmark

[73] Assignee: Ole Berland, Denmark

[21] Appl. No.: 801,141

[22] Filed: May 27, 1977

[30] Foreign Application Priority Data

May 31, 1976 Germany ..... 7617377[U]

[51] Int. Cl.[2] ..... H04R 25/00

[52] U.S. Cl. ..... 179/107 FD

[58] Field of Search ..... 179/107 R, 107 E, 107 FD, 179/107 H, 107 S

*Primary Examiner*—George G. Stellar

*Attorney, Agent, or Firm*—Bucknam and Archer

[57] ABSTRACT

A hearing aid for individuals with a loss of sensitivity to the higher frequencies acoustically attenuates the lower frequencies by providing a sound reproducer coupled to a sound delivering conduit provided with an aperture of prescribed size coupled to a cavity which surrounds the sound reproducer.

4 Claims, 3 Drawing Figures

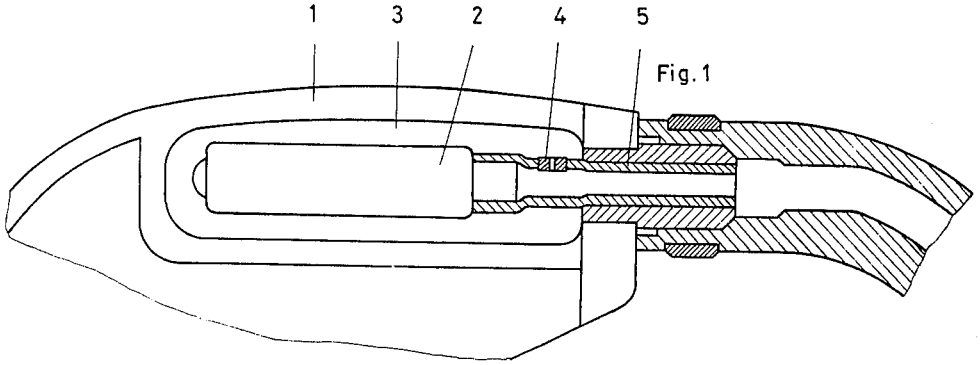
Fig. 1
Fig. 2
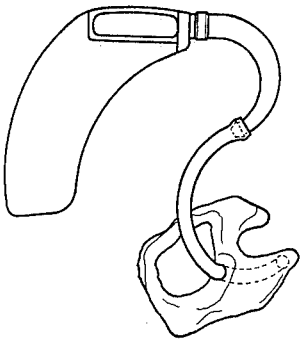
Fig. 3
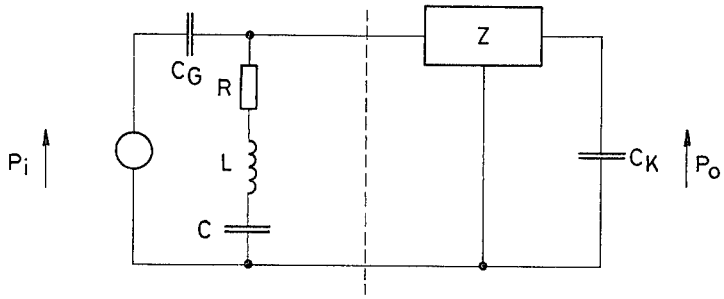

HEARING AID WITH ACOUSTICAL FREQUENCY RESPONSE MODIFICATION

This innovation relates to a hearing aid for persons who are hard of hearing, comprising a sound receiver, amplifier, and sound reproducer, to which a conduit for delivering sound is connected, and it is an object of the invention to facilitate the adaptation of the appliance to the hearing characteristics of the persons who are hard of hearing.

Persons who are hard of hearing lose first the ability to hear the higher sound frequencies. For this reason the adaptation resides, as a rule, in an attenuation of the lower frequencies (generally the frequencies in the range of 0.5 to 2 kHz) so that the entire frequency range can be amplified whereas the lower frequencies are not amplified with the same gain as the higher frequencies.

In accordance with the innovation this adaptation is accomplished by an acoustic loading of the sound-transmitting path between the sound reproducer of the hearing aid and the ear of the person who is hard of hearing. In accordance with the innovation this acoustic loading is accomplished in that one or more openings disposed within the housing lead from the interior of the conduit to a cavity which surrounds the sound reproducer.

In the simplest embodiment, there is at least one opening consisting of a bore through the wall of the conduit. In another suitable arrangement, at least one opening is formed in a bushing, which is inserted in the wall of the conduit.

Alternatively, the opening or openings may be provided in a tube which is connected between the sound reproducer and a flexible tubing. The innovation will be explained more fully with reference to the drawing, in which FIG. 1 is a view showing partly in longitudinal section those parts of a hearing aid which are most important for the innovation.

FIG. 2 shows on a smaller scale the hearing aid which is connected to the ear of a person who is hard of hearing.

FIG. 3 is an equivalent circuit diagram.

The housing of the hearing aid comprises a wall 1, which encloses a cavity 3 which contains the sound reproducer 2 of the appliance. A flexible tubing 5 is connected to the sound reproducer within the housing and extends outwardly through a wall of the housing. A bushing 4 is inserted in the wall of the tubing within the housing. The opening in the bushing 4 leads from the interior of the flexible tubing into the cavity 3. The bushing 4 may have a plurality of openings or may consist of a tube, which is connected between the sound reproducer 2 and the flexible tubing 5 and formed with one or more openings.

The sound pressure generated in the sound reproducer under electrical control is conducted through the flexible tubing 5, which is provided with the bushing 4, to an artificial ear, not shown, which defines a cavity of about 2 $cm^3$, in which a condenser microphone is inserted. The bushing 4 provided with one or more opening constitutes an acoustic load, which attenuates the transmission of sound at lower frequencies.

The equivalent circuit diagram of the system for transmitting sound at lower frequency is shown in FIG. 3. $Pi$ and $Po$ designate, respectively, the sound pressure generated by the sound reproducer and the sound pressure received by the artificial ear, the equivalent parameters of which are designated Z and $Ck$.

The equivalent parameters of the cavity 3 and of the flexible tubing 5, which is provided with the opening according to the innovation, of the hearing aid are designated CG, R, L and C. The opening or openings in the wall of the flexible tubing are so dimensioned that C and R constitute a damped resonant system, which prevents at the same time an acoustic feedback between the sound receiver and the sound reproducer. When the hearing frequency response of a person who is hard of hearing is known, the size of the opening or openings provided according to the invention may be adapted and checked by means of the artificial ear.

I claim:

1. A hearing aid for persons who are hard of hearing, comprising a sound receiver, amplifier, and sound reproducer, to which conduit for delivering sound is connected, characterized in that one or more openings disposed within the housing lead from the interior of the conduit to a cavity which surrounds the sound reproducer.

2. A hearing aid according to claim 1, characterized in that at least one opening consists of a bore through the wall of a flexible tubing.

3. A hearing aid according to claim 1, characterized in that at least one opening is formed in a bushing, which is inserted in the wall of a flexible tubing.

4. A hearing aid according to claim 1, characterized in that the opening or openings is or are formed in a tube which is connected between the sound reproducer and a flexible tubing.

* * * * *